US005806481A

United States Patent [19]

Ikegaya

[11] Patent Number: 5,806,481

[45] Date of Patent: Sep. 15, 1998

[54] CYLINDER BLOCK WITH STEPLESS PLATING COATING AND METHOD FOR FORMING STEPLESS PLATING COATING

[75] Inventor: Hirohiko Ikegaya, Iwata, Japan

[73] Assignee: Yamaha Hatsudoki Kabushiki Kaisha, Iwata, Japan

[21] Appl. No.: 621,256

[22] Filed: Mar. 25, 1996

[30] Foreign Application Priority Data

Mar. 23, 1995 [JP] Japan ..... 7-064364

[51] Int. Cl.[6] ..... F02F 1/00

[52] U.S. Cl. ..... 123/193.2

[58] Field of Search ..... 123/668, 193.2, 123/193.1, 193.3; 29/888.06, 888.061

[56] References Cited

U.S. PATENT DOCUMENTS 5,050,547 9/1991 Takahashi .
5,148,780 9/1992 Urano et al. ..... 123/193.2
5,199,166 4/1993 Torigai et al. ..... 123/193.2
5,315,970 5/1994 Rao et al. ..... 123/193.2
5,619,962 4/1997 Ikegaya et al. ..... 123/668

FOREIGN PATENT DOCUMENTS 0641872 3/1995 European Pat. Off. .
0719917 7/1996 European Pat. Off. .

OTHER PUBLICATIONS

European Search Report dated Dec. 4, 1996.

*Primary Examiner*—Marguerite McMahon
*Attorney, Agent, or Firm*—Knobbe, Martens, Olson & Bear LLP

[57] ABSTRACT

A cylinder block, such as that for an internal combustion engine, having at least one cylinder bore formed by a cylinder wall continuously comprised of a piston-sliding surface and at an end of the cylinder bore a recessed surface, wherein the entire area of the piston-sliding surface is plated without a step thereon, thereby improving durability of the plating coating, especially in an engine downsized while maintaining the displacement volume.

6 Claims, 11 Drawing Sheets

CYLINDER BLOCK WITH STEPLESS PLATING COATING AND METHOD FOR FORMING STEPLESS PLATING COATING

BACKGROUND

1. Field of the Invention

This invention relates to a cylinder block, especially of an internal combustion engine, having at least one cylinder bore, and particularly to such a cylinder block having at least one cylinder bore formed by a cylindrical wall having a step-less plating coating, and a recessed cylindrical wall at an end, which cylinder block allows for preventing the plating coating from being detached at the edge caused by reciprocal movement of a piston. This invention also relates to a method for forming the above plating coating on the cylindrical wall.

2. Background of the Art

Heretofore, in order to lighten engines, cylinder blocks are made of an aluminum alloy in many cases, wherein the cylinder bore walls, i.e., piston-sliding surfaces, are plated with a metal such as nickel so as to improve durability of the walls.

FIG. 9 is a schematic vertical cross-sectional partial view showing a conventional plating apparatus into which a cylinder block is fitted during plating treatment. FIG. 10 is a schematic partial cross-sectional view showing a sealing-associated portion of the plating apparatus of FIG. 9, in which FIG. 10B is a schematic enlarged view of the circled portion of FIG. 10A. A high-speed plating apparatus 80 comprises an upper-surface supporting member 81 and a lower-surface supporting member 82 on which an upper surface 90*a* and a lower surface 90*b* of a cylinder block 90 are respectively placed, and a seal member 83 which is inserted using a shaft 83*a* into a cylinder bore 91 from the upper end. Upper and lower directions in the figures are lower and upper directions in the cylinder block in operation, since the cylinder block is set upside-down when fitted into the plating apparatus. The seal member 83 comprises an upper pressing member 83*b*, a lower pressing member 83*c*, and an O-ring 83*d* which is compressed between the upper pressing member 83*b* and the lower pressing member 83*c*. The upper pressing member 83*b* is connected to the shaft 83*a*. The upper-surface supporting member 81 is provided with a passage-forming cylindrical electrode 85 which is concentrically inserted into the interior of the cylinder bore 91 from the upper end of the cylinder bore 91 in such a way as to maintain a gap between the passage-forming cylindrical electrode 85 and the cylinder bore 91. Plating solution is introduced into the interior of the cylinder bore 91 through a plating solution passage 84 via a plating solution inlet 86, and while flowing along the inner wall of the cylinder bore 91, the plating solution is impressed with a voltage, thereby forming a plating coating 92 on the inner wall of the cylinder bore 91. The plating solution is then moved into a return passage 85*a* formed in the inside of the cylindrical electrode 85, and then returned to a treated-solution recovery passage (not shown). The flow of the plating solution is indicated with arrows in FIG. 9.

The cylinder bore 91 is constituted by a honing surface 91*a*, which is a surface subjected to honing treatment with a honing blade after plating, and a honing-release surface 91*b*, which is a recessed surface for releasing the honing blade, i.e., the diameter of the circumference of the honing-release surface 91*b* is greater than that of the honing surface 91*a*. Both the honing surface 91*a* and the honing-release surface 91*b* are formed when the cylinder block is cast.

During operation of an engine, a piston (not shown) reciprocally slides upon the honing surface 91*a* in such a way that a piston skirt does not protrude from the lower end of the honing surface 91*a* even when the piston reaches the lower dead point. Accordingly, heretofore, only the honing surface 91*a* is plated by sealing the cylinder bore 91 at a lower position of the honing surface with a sealing member 83, as shown in FIGS. 10A and 10B.

The above embodiment is advantageous and economical in view of material costs incurred in metal plating, since only the area upon which the piston slides is plated.

However, despite the above advantage, the above embodiment has a drawback when the piston skirt descends slightly below the lower end of the honing surface. That is, the likelihood of detaching the lower edge of the plating coating 92 from the cylinder wall is significant, especially in a downsized engine in which the piston skirt 93*a* of the piston 93 descends beyond the lower end of the honing surface 91*a* when the piston 93 reaches the lower dead point, i.e., the height of the cylinder block is minimized, in order to realize a high-output downsized engine.

SUMMARY OF THE INVENTION

The present invention has exploited a piston-sliding surface having a plating coating thereon which has excellent durability. It has been found that the above-described drawback is imputed to the piston movement. FIG. 11 is a schematic partial cross-sectional view showing piston-sliding structures of the cylinder block shown in FIG. 9, in which FIG. 11A shows the position of a piston when reaching the lower dead point, FIG. 11B shows the position of the piston when moving up, and FIG. 11C shows an enlarged view of the circled portion of FIG. 11B. The piston is connected to a crank shaft (not shown), and slides vertically and reciprocally upon the cylinder wall corresponding to the crank shaft rotation, causing the piston to wobble slightly in the direction of rotation of the crank shaft, especially at the lower end of the honing surface 91*a* (indicated by an arrow in FIG. 11B). As a result, if there is a step 92*a* on the sliding surface upon which the piston slides, the piston skirt 93*a* of the piston 93 scratches the step 92*a* of the plating coating 92, and thus, the likelihood of detaching the plating coating 92 from the cylinder wall is significant (FIGS. 11A, 11B, and 11C). For the above reason, it was difficult to downsize a cylinder block simply by shortening the height of the cylinder block. An objective of the present invention is therefore to provide a piston-sliding surface having no step on the plating coating formed thereon so as to impart characteristics such as durability and frictional properties to the plating coating.

Namely, one important aspect of the present invention is a cylinder block comprising at least one cylinder bore, said at least one cylinder bore being formed by a cylinder wall continuously comprised of a piston-sliding surface and at an end of said cylinder bore a recessed surface, wherein at least said piston-sliding surface is plated with a plating coating. By forming a plating coating on the entire area of the piston-sliding surface including the connection between the piston-sliding surface and the recessed surface, it is possible to eliminate susceptibility to detachment of any plating coating portion, thereby improving durability of the plating coating even when a piston overreaches the lower end of the piston-sliding surface in a downsized engine.

In the above cylinder block, when a step is formed at the connection between said piston-sliding surface and said recessed surface, said step has an edge covered with said plating coating. When a tapered step is formed at the connection between said piston-sliding surface and said recessed surface, said tapered step has a tapered surface on which the boundary between said plating coating and cylinder material is disposed. When a rounded-off step is formed at the connection between said piston-sliding surface and said recessed surface, said rounded-off step is covered with said plating coating. The above structures are particularly advantageous in an engine cylinder block in which the piston skirt of a piston overreaches the connection between said piston-sliding surface and said recessed surface.

In the above cylinder block, said piston-sliding surface having said plating coating thereon is typically a honing surface which is honed with a honing blade, and said recessed surface is typically a honing-release surface for releasing said honing blade.

Another important aspect of the present invention is a method for forming a plating coating on a wall of a cylinder bore of a cylinder block, said cylinder bore being formed by a cylinder wall continuously comprised of a piston-sliding surface and at an end of said cylinder bore, a recessed surface, said method comprising the steps of: sealing the end of said cylinder bore on the side of said recessed surface at a sealing position disposed on said recessed surface or a wall outwardly continuing from said recessed surface or at the connection between said piston-sliding surface and said recessed circumferential surface; introducing plating solution inside said cylinder bore defined by said sealing position; and plating at least said piston-sliding surface. By sealing the cylinder bore at a position disposed on said recessed surface or a wall outwardly continuing from said recessed surface or at the connection between said piston-sliding surface and said recessed circumferential surface, it is possible to efficiently form a plating coating without a step on the piston-sliding surface.

In the above method, preferably, in the step of introduction of plating solution, said plating solution is permitted to flow along said piston-sliding surface, and during plating, a voltage is exerted onto said plating solution, i.e., the plating system is preferably a high speed plating system.

In the above method, when the sealing position is disposed at the connection between the piston-sliding surface and the recessed surface, the method preferably further comprises tapering the edge of said connection in such a way that the boundary between said plating coating and cylinder material is disposed on the tapered surface. By disposing the boundary on the tapered surface, it is possible to form a plating coating without a step on the piston-sliding surface.

BRIEF DESCRIPTION OF THE FIGURES

FIG. 1 is a schematic vertical cross-sectional view showing one embodiment of a cylinder block and plating apparatus during plating according to the present invention, in which

FIG. 2 is a schematic vertical cross-sectional partial view showing one embodiment of a piston-sliding surface of a cylinder block in operation, in which

FIG. 3 is a schematic vertical cross-sectional partial view showing another embodiment of steps of forming a plating coating on a piston-sliding surface, in which

FIG. 4 is a schematic vertical cross-sectional partial view showing still another embodiment of steps of forming a plating coating on a piston-sliding surface, in which

FIG. 5 is a schematic vertical cross-sectional partial view showing yet another embodiment of steps of forming a plating coating on a piston-sliding surface, in which

FIG. 6 is a schematic vertical cross-sectional partial view showing a further embodiment of steps of forming a plating coating on a piston-sliding surface, in which

FIG. 7 is a schematic vertical cross-sectional partial view showing an example of a plating system for a V-type engine cylinder block according to the present invention, in which

FIG. 8 is a schematic vertical cross-sectional partial view showing an example of production of a cylinder block, in which

FIG. 10 is a schematic partial cross-sectional view showing a sealing-associated portion of the plating apparatus of FIG. 9, in which

FIG. 11 is a schematic partial cross-sectional view showing piston-sliding structures of the cylinder block shown in FIG. 9, in which

DETAILED DESCRIPTION OF THE PREFERRED EMBODIMENT

A plating coating of the present invention can be formed on any piston-sliding surface of a cylinder block having a cylinder bore constituted by the piston-sliding surface and a recessed surface at an end (normally on the side of a crank shaft). A cylinder block having a plating coating of the present invention can be preferably used in internal combustion engines, irrespective of the application of the engine, the number of cylinder bores, two-cycle or four-cycle, the size of displacement of the engine, the material of the cylinder block or the like, although the cylinder block can be used in a compressor or the like. Typically, the plating coating of the present invention is adapted for a vehicle engine such as a automobile engine, a motorcycle engine, outboard engine, and an engine for a refrigerator or freezer, especially a downsized engine, having a sleeveless cylinder block made of an aluminum alloy. A piston-sliding surface is normally subjected to honing treatment with a honing blade after a plating coating is formed thereon, and the recessed surface is necessary to release the honing blade. The diameter of the circumference of a recessed surface is normally 0.5–2.0 mm greater than that of a piston-sliding surface. The length of the recessed surface in the longitudinal direction is normally 20–30 mm, such that the honing blade can easily be released from the cylinder bore. The thickness of a plating coating is normally 20–100 μm, typically 40–60 μm.

Referring now in detail to the drawings, several embodiments of the present invention are explained.

Plating Coating When Sealed on Recessed Surface

Figure 1A:
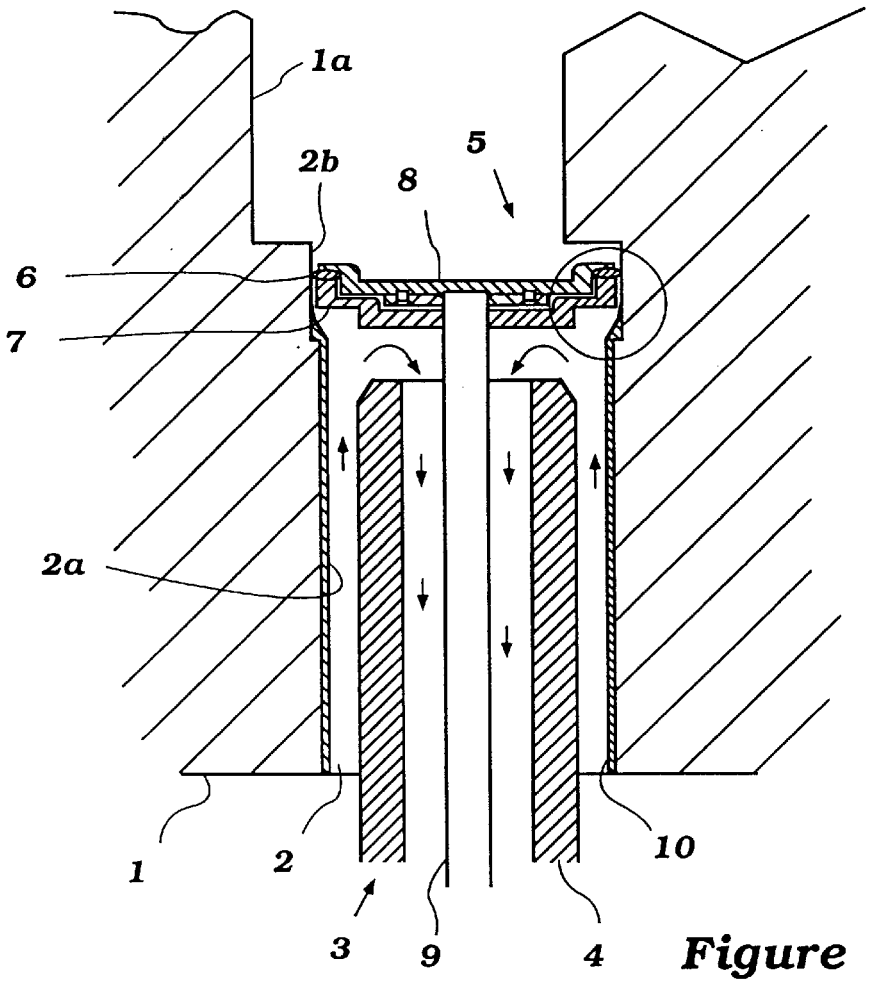
Figure 1B:
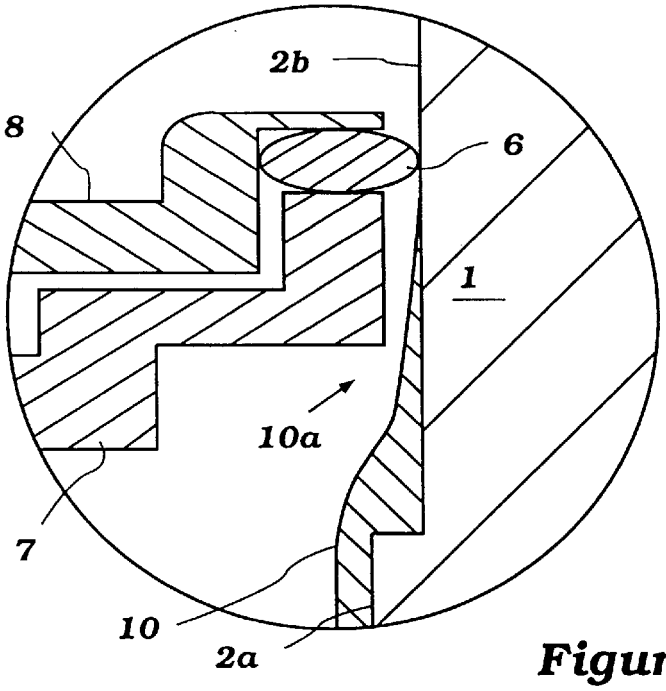
FIG. 1B is a schematic enlarged view of the circled portion of FIG. 1A.
Figure 2A:
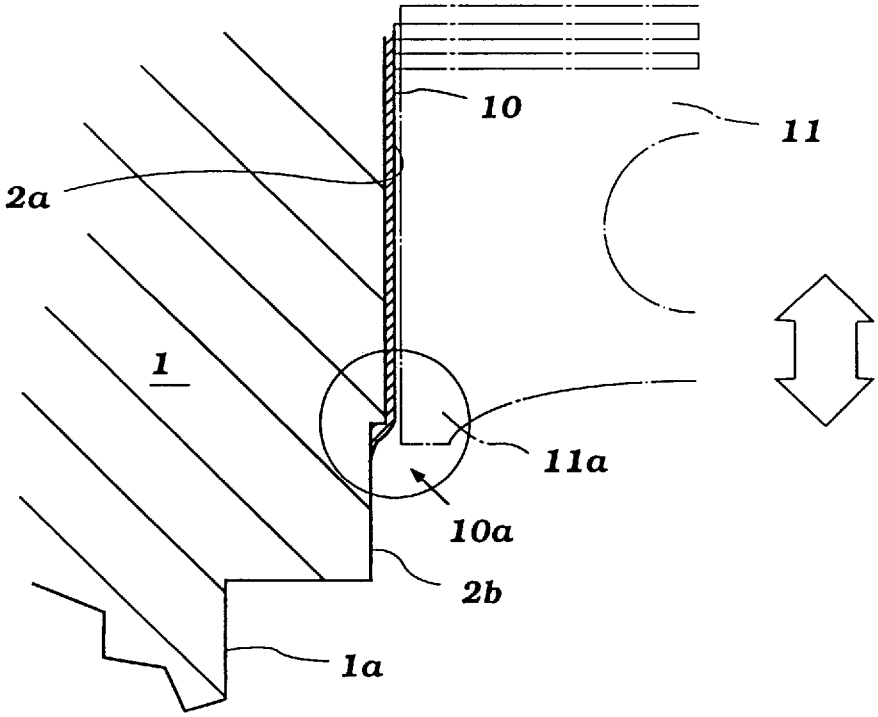
Figure 2B:
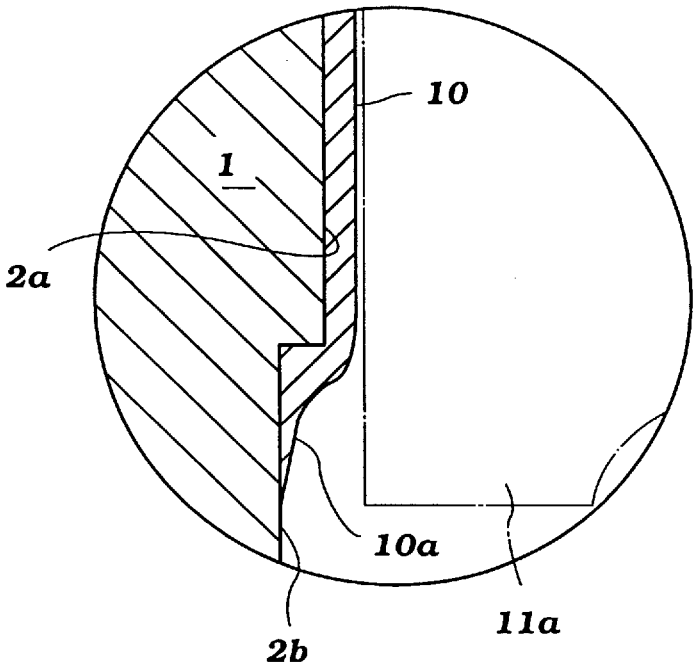
FIG. 2B is a schematic enlarged view of the circled portion of FIG. 2A.

FIG. 1 is a schematic vertical cross-sectional view showing one embodiment of a cylinder block and plating apparatus during plating according to the present invention, in which FIG. 1B is a schematic enlarged view of the circled portion of FIG. 1A. FIG. 2 is a schematic vertical cross-sectional partial view of said piston-sliding surface of the cylinder block in operation, in which FIG. 2B is a schematic enlarged view of the circled portion of FIG. 2A.

Referential numeral 1 is a cast cylinder block made of an aluminum alloy. The cylinder block 1 comprises a cylinder bore 2 in which a piston slides up and down, and the cylinder bore 2 is constituted by a honing surface 2*a*, which is honed with a honing blade of a honing apparatus (not shown) after plating, and a honing-release surface 2*b* for releasing the honing blade from the cylinder bore 2. The honing-release surface has a diameter greater than that of the honing surface, and both the honing surface and the honing-release surface are formed when cast.

The lower portion of the cylinder block 1*a* (the upper portion in this figure as described earlier) has structures (not shown) into which a crank shaft is fitted.

Figure 9:
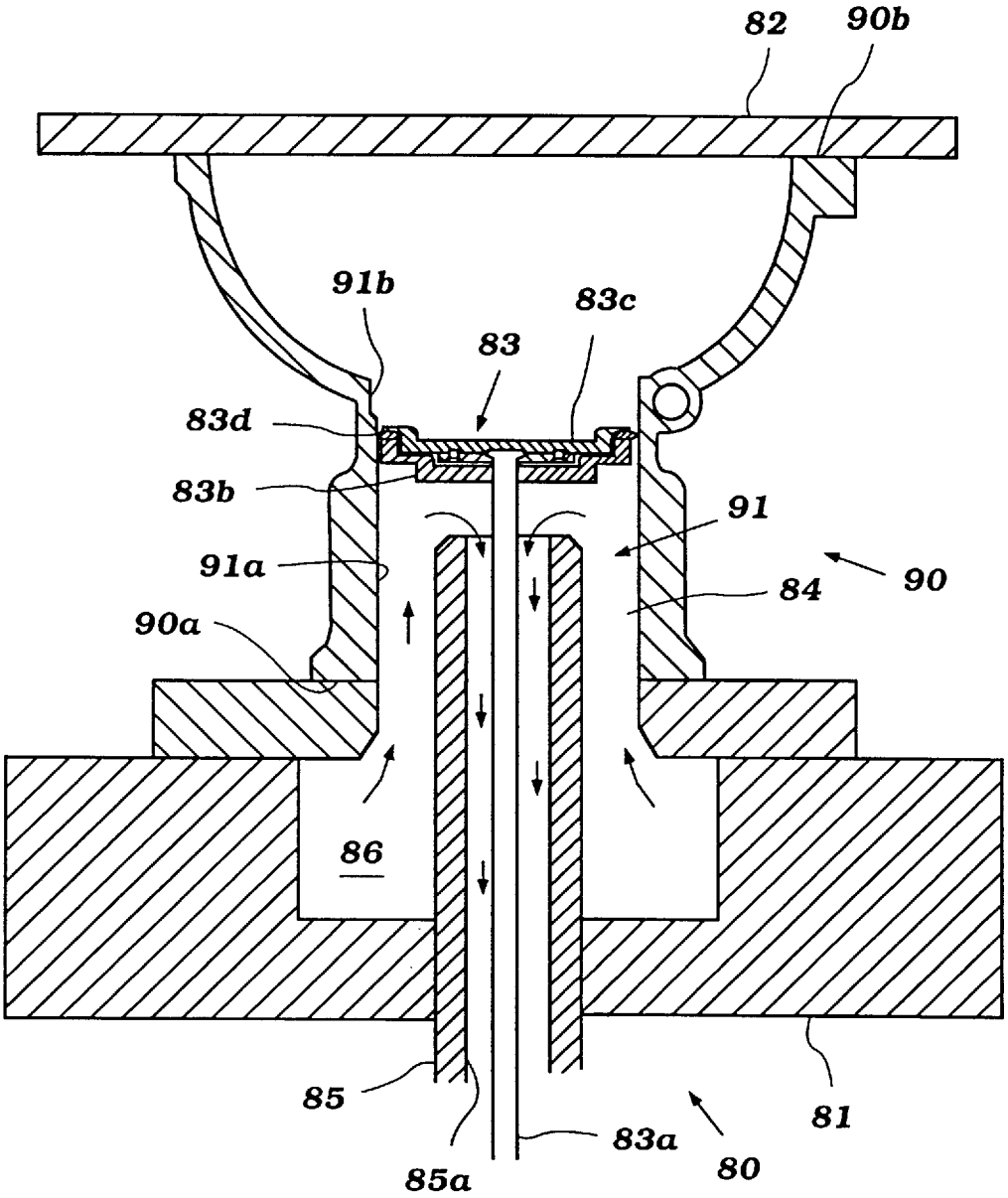
FIG. 9 is a schematic vertical cross-sectional partial view showing a conventional plating apparatus into which a cylinder block is fitted during plating treatment.
Figure 10A:
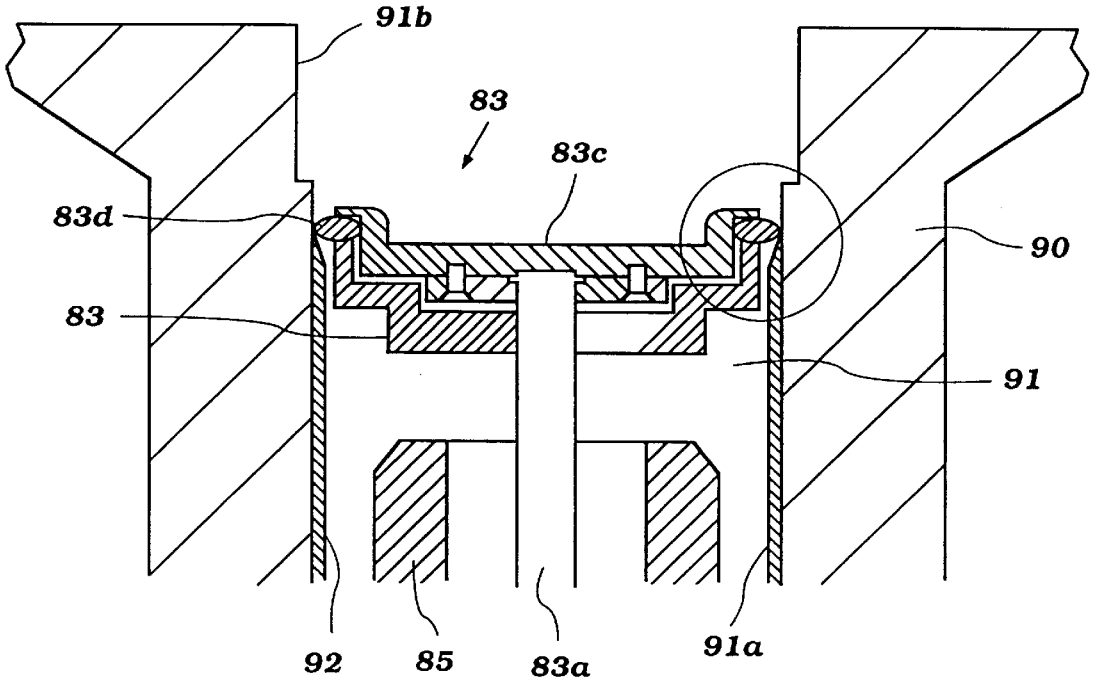
Figure 10B:
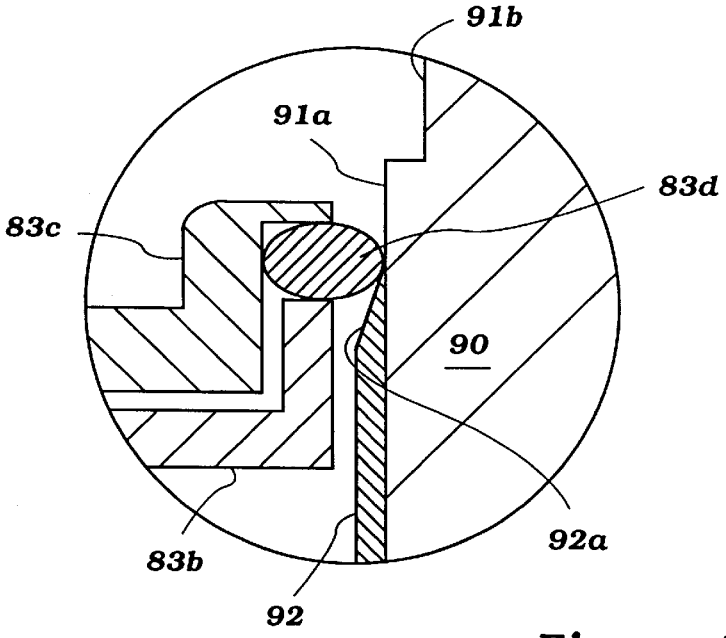
FIG. 10B is a schematic enlarged view of the circled portion of FIG. 10A.
Figure 11A:
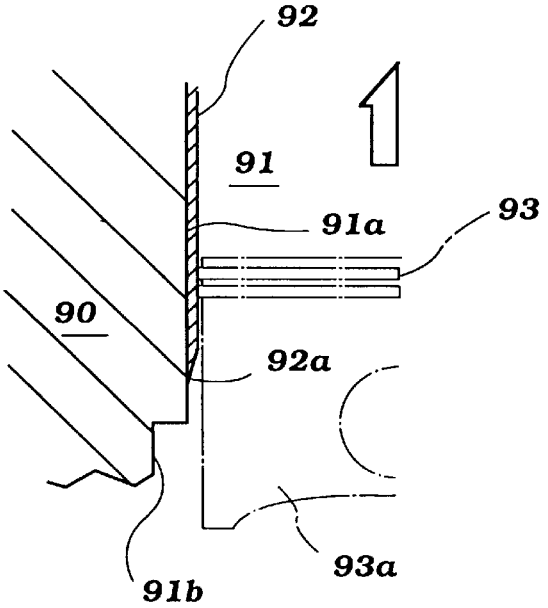
FIG. 11A shows the position of a piston when reaching the lower dead point.
Figure 11B:
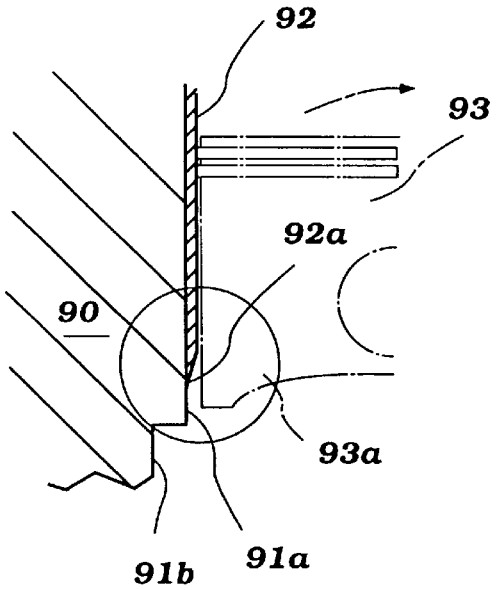
FIG. 11B shows the position of the piston when moving up.
Figure 11C:
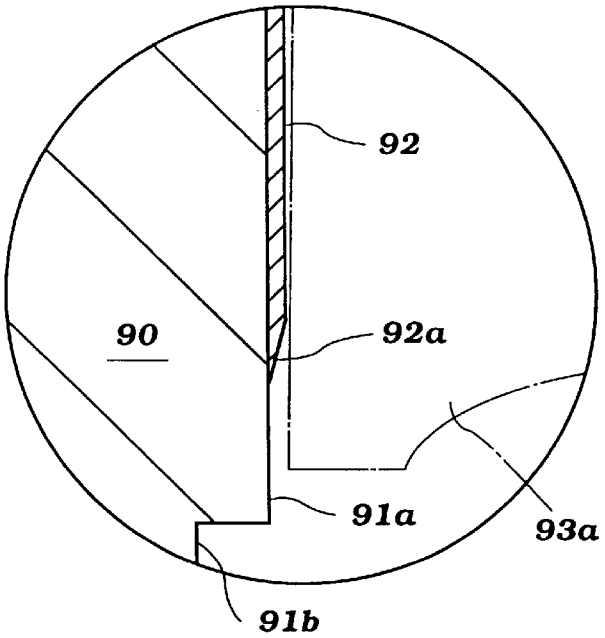
FIG. 11C shows an enlarged view of the circled portion of FIG. 11B.

The wall of the cylinder bore 2 of the cylinder block 1 is plated with a metal such as nickel using a high-speed plating apparatus 3. Since the high-speed plating apparatus 3 may be the same as the high-speed plating apparatus 80 indicated in FIG. 9, parts not relevant to this embodiment is omitted.

In the cylinder bore 2, a passage-forming cylindrical electrode 4 and a seal member 5 are inserted from the lower end (the upper end in this figure). The seal member 5 is comprised of an O-ring 6, pressing members 7 and 8, and a rod 9 connected to the pressing member 7. The rod 9 penetrates the passage-forming cylindrical electrode 4, and is fixed to a supporting member (not shown) above the cylinder block 1 in such a way as to be vertically movable.

The seal member 5 is inserted into the interior of the cylinder bore 2 together with the passage-forming cylindrical electrode 4 and positioned at an appropriate position on the honing-release surface 2*b*, thereby sealing the circumference of the honing-release surface 2*b* of the cylinder bore 2 with the O-ring 6.

Incidentally, in this figure, the rod 9 extends through the passage-forming cylindrical electrode 4. The rod 9 can, however, extend through the lower portion of the cylinder block 1 (i.e., a crank room). The seal member 5 is capable of horizontally retracting when inserted into the cylinder bore 2 and extending when reaching a predetermined position to be sealed. Structures of the seal member 5 other than those with the use of an O-ring can be adapted for this embodiment. Such structures are described in a U.S. patent application titled "Sleeveless Cylinder Block Without Marginal Plating Coating" Ser. No. 08/406,691, filed Mar. 20, 1995 (claiming priority from Japanese Patent Application No. 74317, field Mar. 18, 1994), which is hereby incorporated herein by reference.

After positioning the seal member 5 and sealing the honing-release surface 2*b*, plating solution is permitted to flow along the honing surface 2*a* from the inside to the outside of the passage-forming cylindrical electrode 4, as indicated by arrows in FIG. 1. While the plating solution is flowing, the plating solution is charged with a voltage through the passage-forming cylindrical electrode 4, thereby forming a thin plating coating 10 on the inside wall of the cylinder bore 2. After plating, the plating coating is subjected to honing treatment. The plating coating 10 is formed up to the position of the O-ring 6 of the seal member 5, i.e., formed continuously on the honing surface 2*a* and a part of the honing-release surface through the connection between the two surfaces (FIG. 1B). When the plating coating is formed using a high-speed plating apparatus, it is not necessary to reduce the thickness of the plating coating to a great extent by honing treatment in order to give high roundness, e.g., a honing depth can be as shallow as approximately 20 μm (normally a honing depth of 40–60 μm), because the surface of the plating coating prior to honing treatment is smooth and the thickness is uniform in all directions (after honing a thickness of the plating coating is normally 20–100 μm). A high-speed plating system is described, for example, in a U.S. patent application entitled "Plating Liquid, Plating Method and Plating Cylinder," Ser. No. 08/299,838, filed on Sep. 1, 1994 (claiming priority from Japanese Patent Application No. 218753, filed Sep. 2, 1993), which is hereby incorporated herein by reference.

Based on the steps described above, the cylinder block 1 having the plating coating on the wall of the cylinder bore 2 is obtained, and a piston is inserted in the cylinder bore 2 when an engine is assembled (FIG. 2). The engine has structures in which, when the crank shaft angle reaches the lower dead point, the piston skirt 11*a* of the piston 11 overreaches the end of the honing surface 2*a* and reaches the honing-release surface 2*b*, i.e., the piston slides upon the entire area of the honing surface 2*a*, thereby downsizing the engine by shortening the height of the cylinder block while maintaining a high displacement of the engine.

As clearly understood from FIG. 2, the plating coating 10 formed on the wall of the cylinder bore 2 covers the entire honing surface 2*a* and reaches the honing-release surface 2*b*. Thus, the honing surface 2*a* has no step thereon formed at the edge 10*a* of the plating coating 10, and while the piston skirt 11*a* of the piston 11 is in reciprocal motion, the piston skirt 11*a* does not scratch any step of the plating coating 10, resulting in the plating coating not detaching from the cylinder wall.

Plating Coating with Tapered Step

Figure 3C:
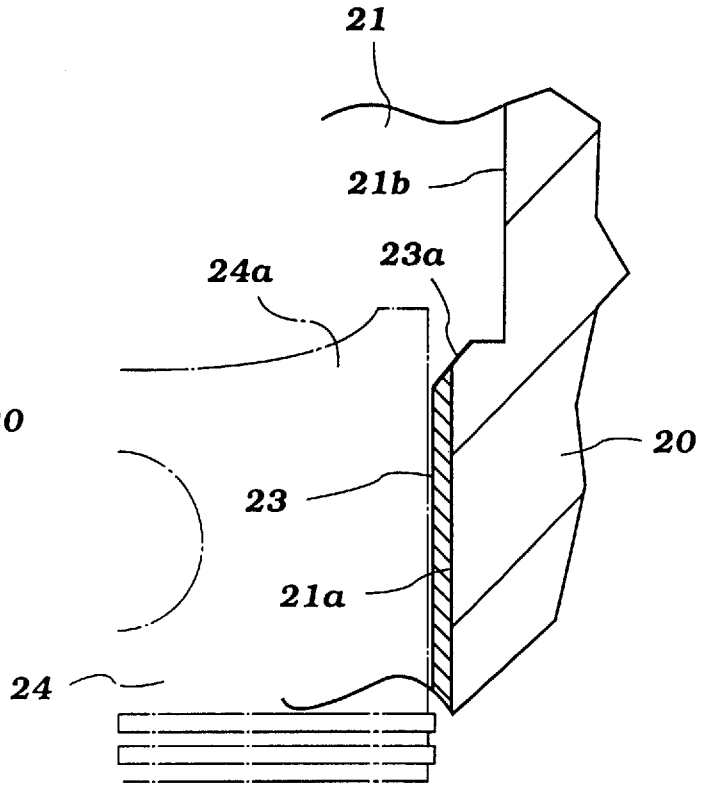
FIG. 3C shows a position of a piston in operation when it reaches the lower dead point.
Figure 3B:
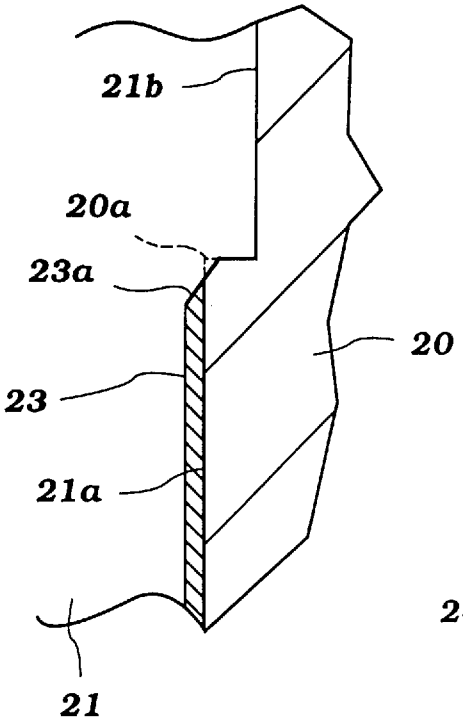
FIG. 3B shows the tapering step.
Figure 3A:
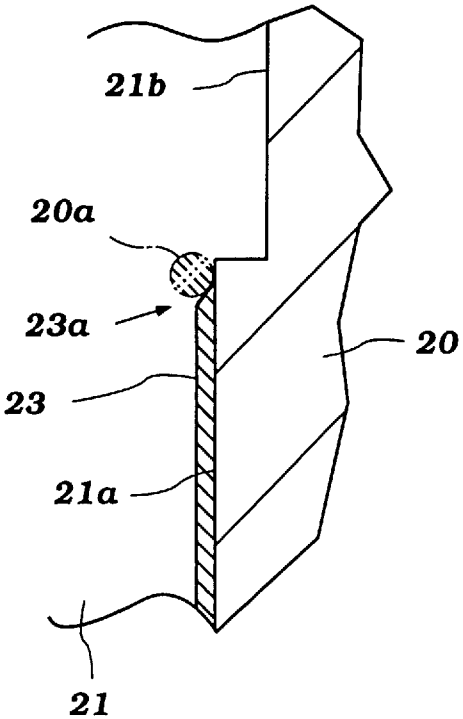
FIG. 3A shows a sealing position.

FIG. 3 is a schematic vertical cross-sectional partial view showing a second embodiment of steps of forming a plating coating on a piston-sliding surface, in which FIG. 3A shows a sealing position, FIG. 3B shows the tapering step, and FIG. 3C shows a position of a piston in operation when it reaches the lower dead point.

Referential numeral 20 in the figure is a cylinder block. The cylinder block 20 is comprised of a cylinder bore 21 which is formed by a honing surface 21*a* and a honing-release surface 21*b*. Both the honing surface 21*a* and the honing-release surface 21*b* are formed when cast, and the honing-release surface 21*b* is circumferentially recessed from the honing surface 21*a*. A seal member of a plating apparatus (not shown) is positioned near the end of the honing surface 21*a* of the cylinder bore 21, and seals the circumference of the honing surface 21*a* with an O-ring 22. After the honing surface is sealed, plating solution is circulated along the honing surface 21*a* of the cylinder bore 21 in the same manner as described in association with FIG. 9, thereby forming a plating coating 23 on the honing surface 21*a* (FIG. 3A).

The edge 20*a*, which remains along the end 23*a* of the plating coating 23 between the honing surface 21*a* and the honing-release surface 21*b*, is tapered off, thereby eliminating any step associated with the end 23*a* of plating coating 23 from the honing surface, i.e., the entire area of the honing surface is plated (FIG. 3B). By eliminating any step formed at the end 23*a* of the plating coating 23, it is possible to prevent a piston skirt 24*a* of a piston 24 from scratching the plating coating 23 (FIG. 3C).

Plating Coating when Sealed on Tapered Step

Figure 4C:
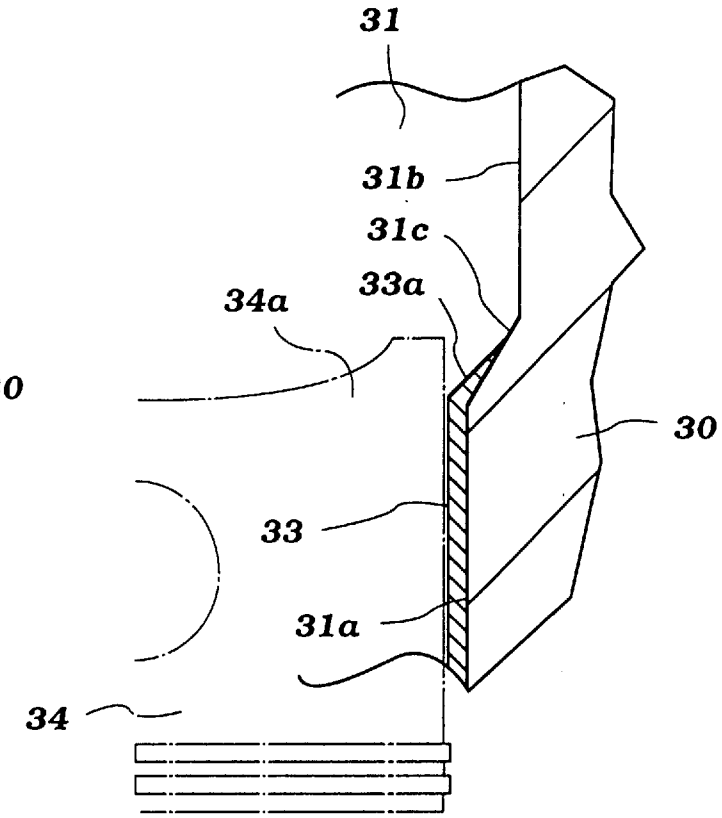
FIG. 4C shows a position of a piston in operation when it reaches the lower dead point.
Figure 4B:
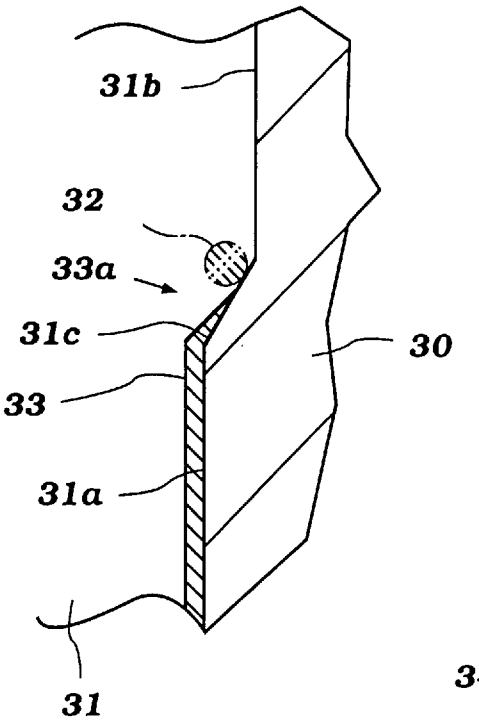
FIG. 4B shows a plating coating formed on a piston-sliding surface.
Figure 4A:
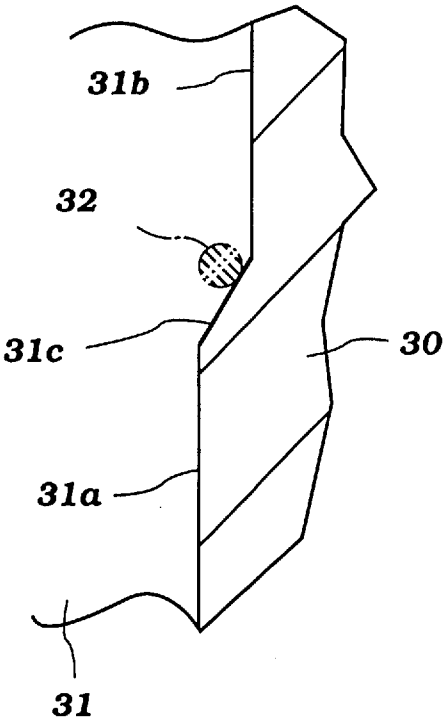
FIG. 4A shows a sealing position.

FIG. 4 is a schematic vertical cross-sectional partial view showing a third embodiment of steps of forming a plating coating on a piston-sliding surface, in which FIG. 4A shows a sealing position, FIG. 4B shows a plating coating formed on a piston-sliding surface, and FIG. 4C shows a position of a piston in operation when it reaches the lower dead point.

Referential numeral 30 in the figure is a cylinder block. The cylinder block 30 is comprised of a cylinder bore 31 which is formed by a honing surface 31*a* and a honing-release surface 31*b*, and a tapered step 31*c* which is formed between the honing surface 31*a* and the honing-release surface 31*b*. Both the honing surface 31*a* and the honing-release surface 31*b* are formed when cast. The honing-release surface 31*b* is circumferentially recessed from the honing surface 31*a* via the tapered step 31*c*. The tapered step 31*c* is formed when cast or formed by cutting off the edge (not shown) after cast. A seal member of a plating apparatus (not shown) is positioned on the tapered step 31*a* of the cylinder bore 31, and seals the circumference of the tapered step 31*a* with an O-ring 32 (FIG. 4A). After the seal is complete, plating solution is circulated along the honing surface 31*a* of the cylinder bore 31 in the same manner as described in association with FIG. 9, thereby forming a plating coating 33 on the honing surface 31*a* and the tapered step 31*c* (FIG. 4B).

The plating coating 33 formed as described above covers the wall of the cylinder bore 31 up to the position on the tapered step 31*c* where the O-ring 32 is positioned, thereby forming an edge 33*a*. The tapered step 31*c* continues from the lower end of the honing surface 31*a* to the upper end of the honing-release surface 31*b* through the tapered step 31*c*. Thus, even when the piston skirt 34*a* of the piston 34 overreaches the lower end of the honing surface 31*a* and reaches the honing-release surface 31*b* while the engine is operated, the piston skirt 34*a* does not scratch the plating coating 33, thereby preventing detachment of the plating coating 33 from the wall of the cylinder bore.

Figure 5C:
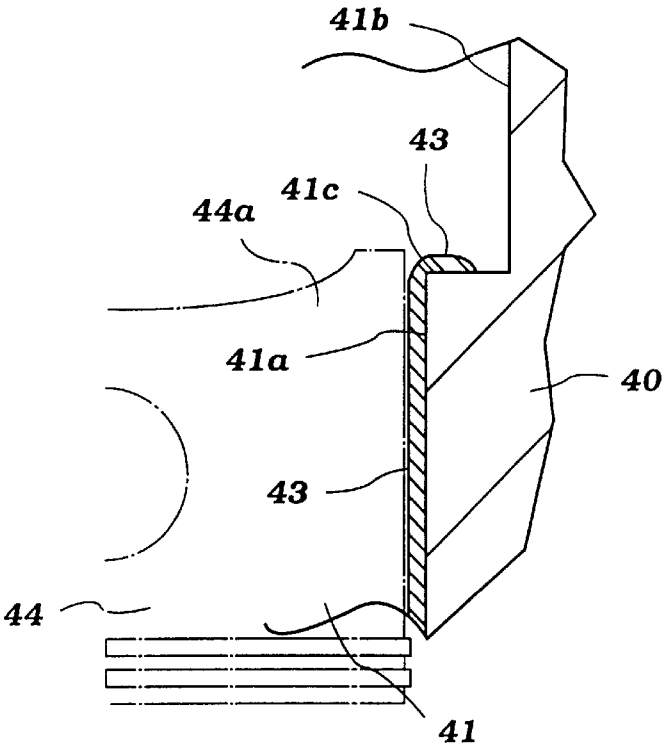
FIG. 5C shows a position of a piston in operation when it reaches the lower dead point.
Figure 5B:
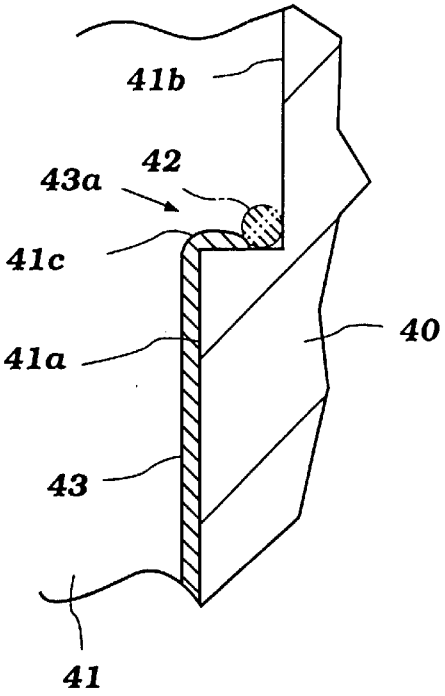
FIG. 5B shows a plating coating formed on a piston-sliding surface.
Figure 5A:
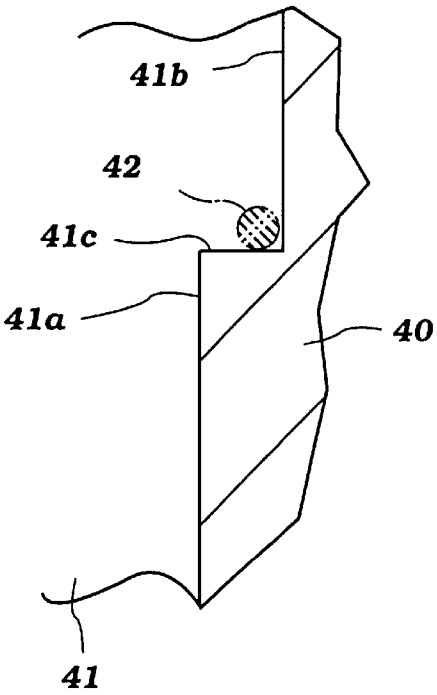
FIG. 5A shows a sealing position.

Plating Coating When Sealed at Step FIG. 5 is a schematic vertical cross-sectional partial view showing a fourth embodiment of steps of forming a plating coating on a piston-sliding surface, in which FIG. 5A shows a second position, FIG. 5B shows a plating coating formed on a piston-sliding surface, and FIG. 5C shows a position of a piston in operation when it reaches the lower dead point.

Referential numeral 40 in the figure is a cylinder block. The cylinder block 40 is comprised of a cylinder bore 41 which is formed by a honing surface 41*a* and a honing-release surface 41*b*. Both the honing surface 41*a* and the honing-release surface 41*b* are formed when cast. The honing-release surface 41*b* is circumferentially recessed from the honing surface 41*a*. The diameter of the circumference of the honing-release surface is greater than those in the previous embodiments (FIGS. 2–4), i.e., a boundary area 41*c* between the honing surface 41*a* and the honing-release surface 41*b* is relatively wide, e.g., preferably as wide as 2 mm or more. A seal member of a plating apparatus (not shown) is positioned at a position on the boundary area 41*c*, and seals the circumference of the boundary area 41*c* with an O-ring 42 (FIG. 5A). After the seal is complete, plating solution is circulated along the honing surface 41*a* of the cylinder bore 41 in the same manner as described in association with FIG. 9, thereby forming a plating coating 43 on the honing surface 41*a* and the boundary area 41*c* up to the position where the O-ring 42 is positioned (FIG. 5B).

The plating coating 43 formed as described above covers the boundary area 41*b* recessed perpendicular to the honing surface 41*a*, up to the position where the O-ring 42 is positioned, and an edge 43*a* of the plating coating 43 remains on the boundary area, i.e., there is no step on the honing surface 41*a* (FIG. 5C). Thus, even when the piston skirt 44*a* of the piston 44 overreaches the lower end of the honing surface 41*a* and reaches the honing-release surface 41*b* while the engine is operated, the piston skirt 44*a* does not scratch the plating coating 43, thereby preventing detachment of the plating coating 43 from the wall of the cylinder bore.

Plating Coating with Rounded-Off Step

Figure 6C:
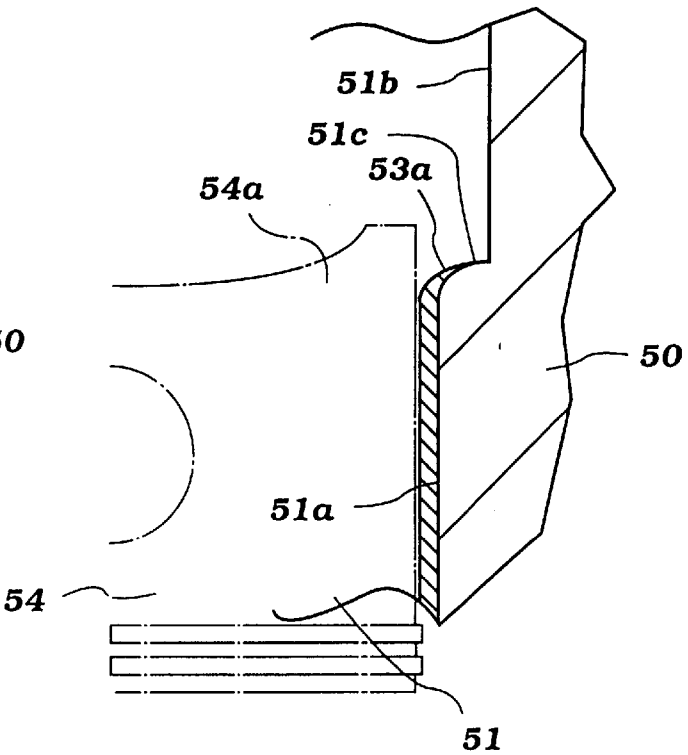
FIG. 6C shows a position of a piston in operation when it reaches the lower dead point.
Figure 6B:
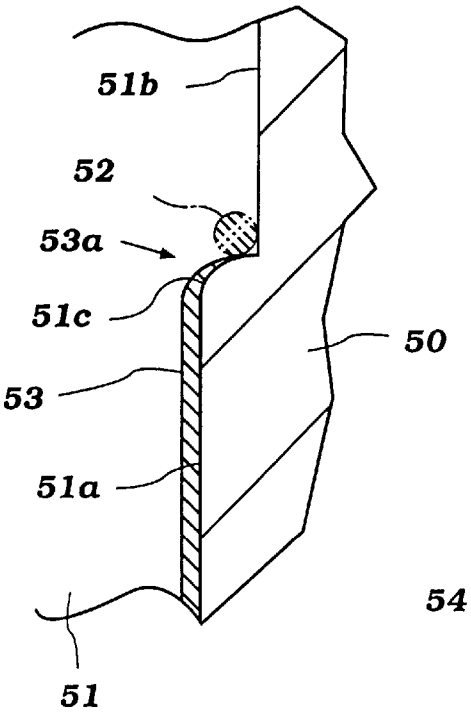
FIG. 6B shows a plating coating formed on a piston-sliding surface.
Figure 6A:
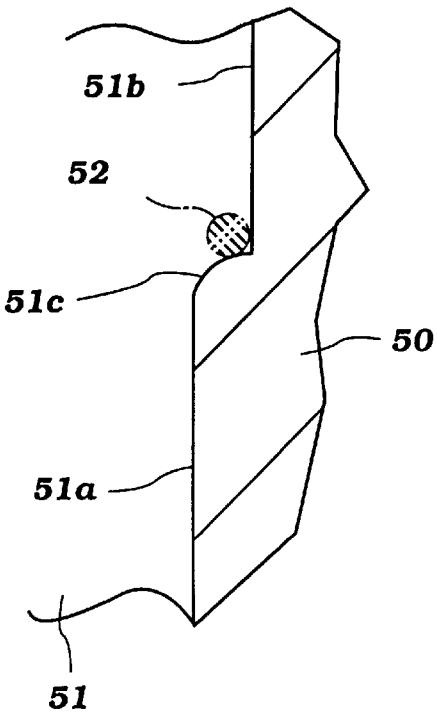
FIG. 6A shows a sealing position.

FIG. 6 is a schematic vertical cross-sectional partial view showing a fifth embodiment of steps of forming a plating coating on a piston-sliding surface, in which FIG. 6A shows a sealing position, FIG. 6B shows a plating coating formed on a piston-sliding surface, and FIG. 6C shows a position of a piston in operation when it reaches the lower dead point.

Referential numeral 50 in the figure is a cylinder block. The cylinder block 50 is comprised of a cylinder bore 51 which is formed by a honing surface 51*a* and a honing-release surface 51*b*, and a rounded-off step 51*c* between the honing surface 51*a* and the honing-release surface 51*b*. Both the honing surface 51*a* and the honing-release surface 51*b* are formed when cast. The honing-release surface 51*b* is circumferentially recessed from the honing surface 51*a*. The rounded-off step 51*c* is formed when cast or formed by cutting off the edge (not shown) after cast. A seal member of a plating apparatus (not shown) is positioned at a position on the rounded-off step 51*c*, and seals the circumference of the rounded-off step 51*c* with an O-ring 52 (FIG. 6A). After the seal is complete, plating solution is circulated along the honing surface 51*a* of the cylinder bore 51 in the same manner as described in association with FIG. 9, thereby forming a plating coating 53 on the honing surface 51*a* and the rounded-off step 51*c* up to the position where the O-ring 52 is positioned (FIG. 6B).

The plating coating 53 formed as described above covers the rounded-off step 51*c* up to the position where the O-ring 42 is positioned, and an edge 53*a* of the plating coating 53 remains on the rounded-off step 51*c*, i.e., there is no step on the honing surface 51*a* (FIG. 6C). Thus, even when the piston skirt 54*a* of the piston 54 overreaches the lower end of the honing surface 51*a* and reaches the honing-release surface 51*b* while the engine is operated, the piston skirt 54*a* does not scratch the plating coating 53, thereby preventing detachment of the plating coating 53 from the wall of the cylinder bore.

Plating Coating in V-Type Cylinder Block

Figure 7A:
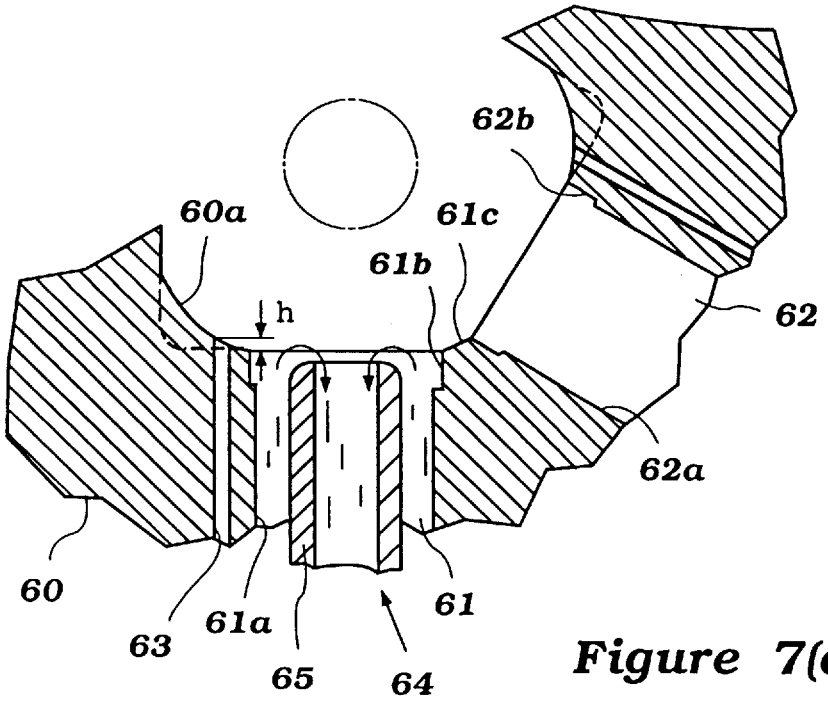
FIG. 7A shows a preliminary plating treatment.
Figure 7B:
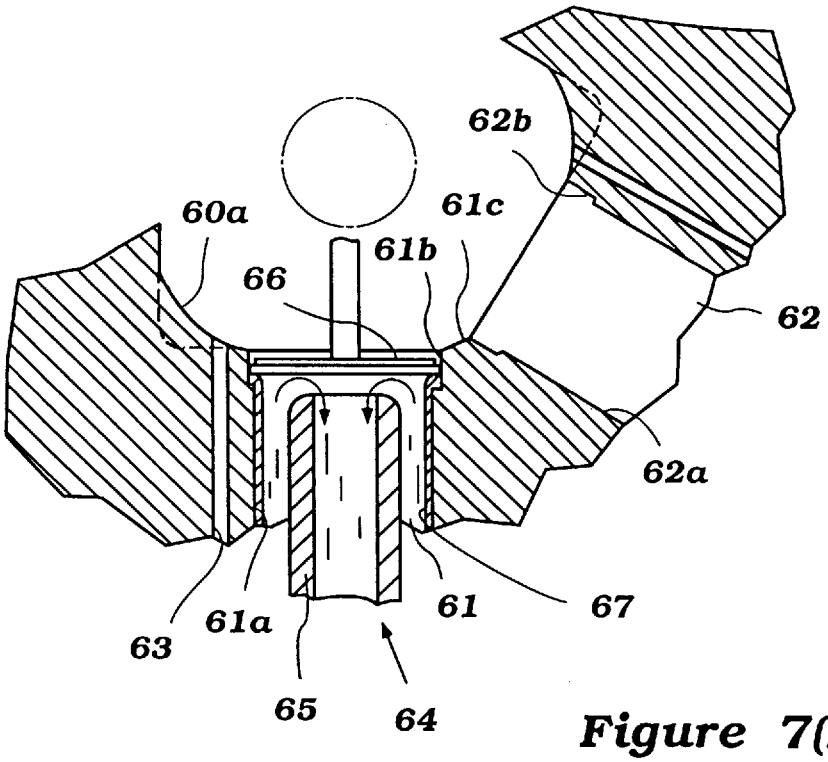
FIG. 7B shows the plating treatment.

FIG. 7 is a schematic vertical cross-sectional partial view showing an example of a plating system for a V-type engine cylinder block according to the present invention, in which FIG. 7A shows a preliminary plating treatment, and FIG. 7B shows the plating treatment.

Referential numeral 60 is a cylinder block which has two parallel alignments of cylinder bores, which are symmetrical based on a center C. In the figure, the cylinder block 60 is cross-sectioned in a direction perpendicular to the alignment of the cylinder bores, showing cylinder bores 61 and 62. The cylinder bores 61 and 62 have the respective honing surfaces 61*a* and 62*a*, and the respective honing-release surfaces 61*b* and 62*b*. The honing-release surfaces 61*b* and 62*b* are recessed from the respective honing surfaces 61*a* and 62*a*.

After cast, the cylinder block 60 having the above structures is subjected to cutting and grinding processes so as to treat the inside of the cylinder bores 61 and 62, and is further treated to form various channels for oil, gas, and the like (passage 63 is shown, for example). The cylinder block 60 is then subjected to plating treatment, and fitted to a high-speed plating apparatus 64.

After the cylinder block 60 is fitted to the high-speed plating apparatus 64, first, without sealing the cylinder bore 61, a solution for preliminary treatment, such as degreasing treatment, alkali etching treatment, mixed acid treatment, and alumite-forming treatment, is permitted to flow along the inner wall of a cylinder bore 61 from the outside to the inside of a passage-forming cylindrical electrode 65. Although most of the solution for preliminary treatment flows into the inside of the passage-forming cylindrical electrode 65, some of the solution overflows from the bottom of the cylinder bore 61, since the bottom of the cylinder bore 61 is not sealed.

Heretofore, in most of engines of this type, a wall below the cylinder bore (i.e., a wall of a crank room 60*a*) extends from the bottom of the cylinder bore 61 in an approximately horizontal direction, and then extends in an approximately vertical direction, as indicated by a broken line in FIG. 7A. In the above structures, solution for preliminary treatment, which overflows from the bottom of the cylinder bore 61, flows into the passage 63 when the bottom of the cylinder bore 61 is not sealed. The passage 63 has complicated structures such that the passage is spread through many gaps in the cylinder block 60 so as to communicate with many parts of the cylinder block. Thus, when the solution for preliminary treatment flows into the passage 63, there is a high likelihood that the passage will become choked or plugged. In contrast, the cylinder block 60 shown in FIG. 7 has structures in which the wall 60*a* under the cylinder bore 60 (in the crank room) is gradually tapered from the bottom of the cylinder bore 61, and the level of the entrance of the passage 63 has height "h". Thus, without sealing the bottom of the cylinder bore 61, it is possible to permit the solution to flow through the inside of the cylinder bore 61, while preventing the solution from flowing into the passage 63.

After the above preliminary treatment, the circumference of the honing-release surface 61*b* of the cylinder bore 61 is sealed with a seal member 66, followed by plating treatment. Plating solution is permitted to flow between the outside of the passage-forming cylindrical electrode 65 and the inside of the cylinder bore 61, while impressing a voltage therebetween through the passage-forming cylindrical electrode 65. The plating solution then flows into the inside of the passage-forming cylindrical electrode 65 while depositing a plating coating on the wall of the cylinder bore 61. Accordingly, a plating coating 67 is formed on the honing surface 61*a* and the honing-release surface 61*b* up to the position where the seal member 66 is positioned. The plating coating 67 ends on the honing-release surface 61*b* and forms an edge thereon, i.e., the step is not on the level of the piston-sliding surface of the honing surface 61*a*.

In this embodiment shown in FIG. 7, the honing-release surface 61*b* is sealed with the seal member 66 to plate the wall of the cylinder bore 61. The sealing position can be located in different parts of the inner wall of the cylinder bore 61. For example, the cylinder bore 61 can be circumferentially sealed on a wall 61*c* extending from the bottom of the cylinder bore 61, thereby plating the entire inner wall of the cylinder bore 61 and the wall 61*c* up to the position where the seal member 66 is positioned.

A work station for plating a V-type engine cylinder block, which can be adapted for this embodiment, is described in a U.S. patent application titled "Method and Apparatus for Surface Treatment of Work Having Plural Cylinders with Different Axis Alignments" Ser. No. 08/483,247, filed Jun. 7, 1995 (claiming priority from Japanese Patent Application No. 228409, field Sep. 22, 1994), which is hereby incorporated herein by reference.

Figure 8A:
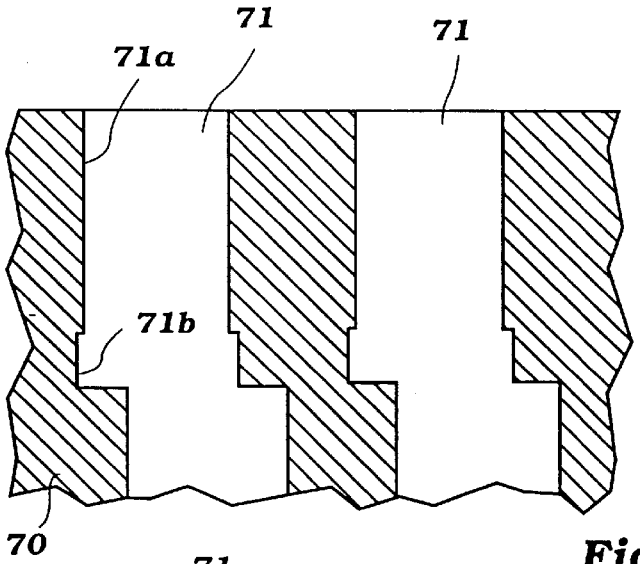
FIG. 8A shows the cylinder block upon being cast.
Figure 8B:
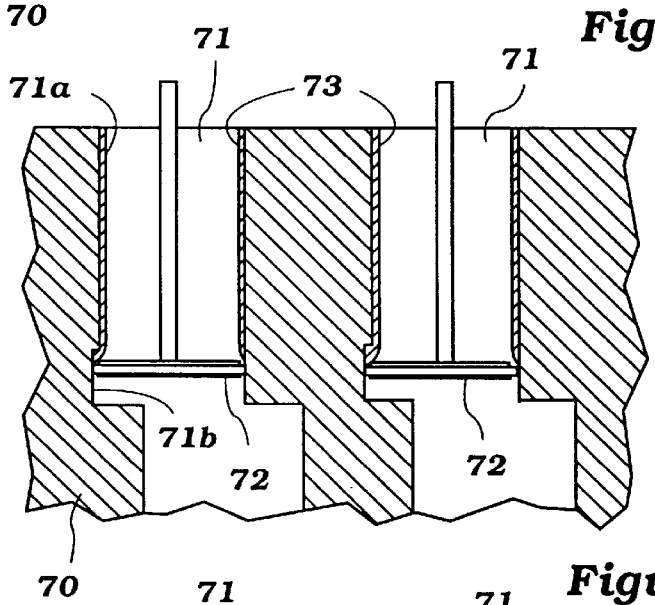
FIG. 8B shows the cylinder block during plating treatment.
Figure 8C:
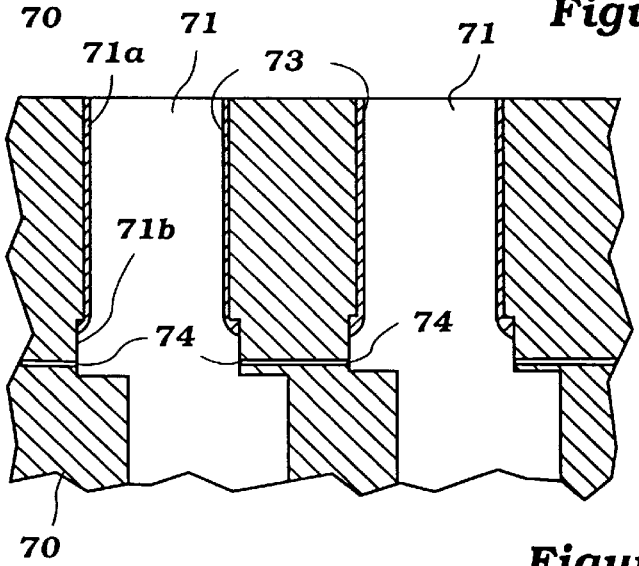
FIG. 8C shows the cylinder block after communication channels are formed.

FIG. 8 is a schematic vertical cross-sectional partial view in association with the V-type engine cylinder block described above, in which FIG. 8A shows the cylinder block upon being cast, FIG. 8B shows the cylinder block during plating treatment, and FIG. 8C shows the cylinder block after communication channels are formed.

As shown in this figure, a cast cylinder block 70 (FIG. 8A) undergoes cutting and grinding processes to treat the inner wall of a cylinder bore 71, and then is subjected to plating treatment to plate the inner wall of the cylinder bore 71 in a high-speed plating apparatus (FIG. 8B). In the plating treatment, a seal member 72 is positioned at a position on a honing-release surface 71*b* of the cylinder bore 71, similarly to the embodiments indicated in FIGS. 1–7, in order to form a plating coating 73 on the honing surface 71*a* without forming any step thereon.

After the plating treatment, channel excavation treatment is conducted to form an oil channel, a gas channel, and the like. In FIG. 8C, after the plating treatment, a communication channel 74, which communicates the side-by-side cylinder bores 71, is formed on the honing-release surface 71*b*. As shown above, since channel excavation treatment is conducted after plating treatment, there is no restriction imposed on the area to be sealed for plating treatment, thereby rendering the plating treatment simple.

It will be understood by those of skill in the art that numerous variations and modifications can be made without departing from the spirit of the present invention. Therefore, it should be clearly understood that the forms of the present invention are illustrative only and are not intended to limit the scope of the present invention.

I claim:

1. A cylinder block comprising a body member forming at least one cylinder bore extending between an outer surface adapted to be closed by a cylinder head and an area adapted to form a crankcase chamber in which a crankshaft rotates, said at least one cylinder bore being formed by a cylinder wall surface comprised of a piston-sliding surface portion adapted to be slidably engaged by a sealing portion of an associated piston reciprocating in said cylinder bore, said piston-sliding surface portion extending from a first end at said body member outer surface to a second end contiguous to said area and a recessed surface portion extending from said second end to said area, a plated coating on at least said piston-sliding surface portion.

2. A cylinder block according to claim 1, wherein a step is formed at the connection between said piston-sliding surface portion and said recessed surface portion, said step having an edge covered with said plating coating.

3. A cylinder block according to claim 1, wherein a tapered step is formed at the connection between said piston-sliding surface portion and said recessed surface portion, said tapered step having a tapered surface on which a boundary between said plating coating and the base cylinder material of said body member is disposed.

4. A cylinder block according to claim 1, wherein a rounded-off step is formed at the connection between said piston-sliding surface portion and said recessed surface, said rounded-off step being covered with said plating coating.

5. A cylinder block according to claim 1, wherein said piston-sliding surface portion has sufficient length to be engaged by the sealing surface of the piston throughout its stroke and a skirt of the piston below its sealing surface will extend into said recessed surface portion when the piston is at bottom dead center.

6. A cylinder block according to claim 1, wherein the plated coating on said piston-sliding surface portion is honed with a honing tool and said recessed surface portion is of sufficient diameter for releasing said honing without engagement.

* * * * *